United States Patent [19]

Brawner et al.

[11] 3,953,994

[45] May 4, 1976

[54] CAN BODIES AND METHOD AND APPARATUS FOR MANUFACTURE THEREOF

[75] Inventors: William H. Brawner, Anaheim; Claude A. Gunsalus, Covina; Lowell K. Rockwell, Walnut, all of Calif.

[73] Assignees: Dale E. Summer, Tiburon; Lowell K. Rockwell, Walnut; Paul C. Rogers, Whittier; Nick A. Laznibat, Fullerton; Claude A. Gunsalus, Covina; William H. Brawner, Anaheim; Gordon R. Kimmich, Newhall; Leonard J. Plourde, Canoga Park; Marcus W. McGuire, El Cason; George F. Smyth, Los Angeles, all of Calif. ; part interest to each

[22] Filed: Apr. 24, 1972

[21] Appl. No.: 247,203

Related U.S. Application Data

[62] Division of Ser. No. 884,299, Dec. 11, 1969, Pat. No. 3,698,337.

[52] U.S. Cl. ..... 72/58; 72/62; 72/DIG. 14

[51] Int. Cl.[2] ..... B21D 51/26

[58] Field of Search ..... 72/56, 63, 60, 61, 62, 72/DIG. 14; 113/120 M; 29/421

[56] References Cited

UNITED STATES PATENTS

| | | | |
|---|---|---|---|
| 2,966,872 | 1/1961 | Schmocker | 72/55 |
| 3,051,112 | 8/1962 | VanLeer et al. | 72/63 |
| 3,310,972 | 3/1967 | Erlandson et al. | 72/56 |
| 3,486,703 | 12/1969 | Sorlie | 72/61 |
| 3,559,435 | 2/1971 | Gerber | 72/56 |
| 3,566,648 | 3/1971 | Norin et al. | 72/56 |

*Primary Examiner*—Lowell A. Larson
*Attorney, Agent, or Firm*—George F. Smyth

[57] ABSTRACT

A tubular can body comprising a radially expanded central portion, a neck at each end of the central portion, and a radially extending flange adjacent each neck at the ends of the tubular member. A tubular, elastomeric member is positioned within a die-contained can body and is pressurized to mold the can body to the shape of the die. The operation forms a radially expanded can body, necks the can body adjacent the radially expanded portion, and flanges the ends of the body in a single operation. A tapered elastomeric mandrel may be utilized in place of the tubular mandrel, obviating the necessity of lubricating the mandrel and allowing the body to be axially extended so that the material from which the can is formed is altered in cross section both radially and axially. A structural groove, suitably positioned in the mandrel surface allows flanging to be effected at the upper end of the can body without damage to the mandrel. Alternatively, an expandable member may be substituted in place of either the tubular or tapered mandrel to form the can body through use of hydraulic pressure.

11 Claims, 14 Drawing Figures

31
33
13
35
11
51
47
36
43
27
41
37
39
23
45
49
21
25
29
21
15
17
19
131
133
135
111
151
136
143
153
123
147
137
141
127
155
145
149
159
157
121
129
115
117
119

Prior Art

CAN BODIES AND METHOD AND APPARATUS FOR MANUFACTURE THEREOF

This is a division, of application Ser. No. 884,299, filed 12-11-69 now Pat. No. 3,698,337.

BACKGROUND OF THE INVENTION

Recent advances in the technology of can manufacturing, such as easy-open ends, improved seam welding, etc., have resulted in a rapidly expanding utilization of cans for the transportation, storage, and dispensation of beverages, foods, and so forth. As can usage has increased, a wide variety of concepts have been devised in attempting to reduce the cost of each individual can so as to provide greater product economy. Such concepts have included further improvements in can seam bonding, reduction in the quantity of metal used in each can, and improvements in the methods and apparatus used for making cans.

One object which has long been pursued by the industry has been to manufacture a can having a satisfactory volume for product containment, a reduced quantity and weight of metal, and a sufficient strength to resist can wall damage. This has been accomplished, to some extent, by the use of aluminum which, due to its ductility, may be drawn to such an extent that a can bottom can be formed integral with the body walls. Use of aluminum allows cans to be produced which have a minimum amount of metal in the walls and a large concentration of metal adjacent to and in the bottom for structural strength.

Relative lack of ductility prevents steel cans from being drawn having integral walls and bottoms, with the resultant material distribution, but the advantages of aluminum are largely offset by the lower cost of steel.

In manufacturing cans today, whether steel, aluminum, or other material, a longitudinal section adjacent each open end of each can body is formed into a generally radially outwardly directed flange. The flange is provided on each open end so that a can end (top or bottom) may be mounted thereon in a well-known manner.

If it is desired to form a can having a diameter of 2-11/16 inches, for example, can bodies are cut and seamed at that diameter. The flanges are then formed at the ends of the can and a 2-11/16 inch can end is suitably fastened to the flange.

When can ends are placed on a body formed in accordance with the prior art, the ends have diameters which are greater than that of the body so that the ends extend beyond the body walls. When two cans are placed next to one another, the can ends are in abutment and the bodies are spaced apart by an amount equal to the difference between the sum of the radii of the can ends and the sum of the external radii of the bodies, thereby resulting in a waste in storage space equal to the total separation between the external wall surfaces of the adjacent cans.

Some aluminum cans having the previously described integral body are provided with a neck just below the flange to increase the wall strength of the can so that it will withstand the forces imposed when a can end is installed on the flange. This also allows a slightly smaller can end to be used, such as a 2-9/16 inch end on a 2-11/16 inch body, and obviates the problem discussed in the last paragraph. However, the necks and flanges for these cans have been provided in two distinct operations, requiring two different machines.

With respect to another aspect of the present invention, several concepts have been developed for the expansion of can bodies into a variety of shapes such as barrels, etc. Many of these concepts have required expensive and cumbersome equipment such as multipart mandrels, electro-hydraulic shock wave distribution systems, etc. All of these concepts have been directed toward reshaping can bodies to produce commercially attractive containers. None of the prior art has been directed to — or resulted in — enlarging of the can body so as to maintain substantially the original body shape while decreasing the weight of the can per unit volume contained therein. Additionally, all of the known prior art has been directed to concepts in which, as the can body is expanded, the axial length of the body is shortened. The results of these concepts have been cans which, while containing a slightly greater volume, do so only because of the fact that they have been reformed into shapes approaching spheres, rather than having been stretched to merely enlarge their original shape.

SUMMARY OF THE INVENTION

The present invention comprises a new can body which may be formed by novel apparatus in accordance with a new and unobvious method.

In its simplest form, a can body formed in accordance with the present invention basically comprises a cylindrical body which has been expanded throughout a majority of the length thereof to enclose a greater volume. Although the word "cylinder" usually connotes a body having a circular cross section, it is mathematically defined as, "the surface traced by a straight line moving parallel to a fixed straight line and intersecting a fixed curve; the space bounded by any such surface and two parallel planes cutting all the elements." This definition includes bodies having circular, square, rectangular, hexagonal, etc., cross sections. It is intended therefore, that the use of the word "cylinder" in the specification and claims be understood to refer to any such body wherein the fixed curve is closed or continuous, regardless of the shape of a cross section taken perpendicular to the axis-or fixed straight line-thereof. In like manner, the use of the term "diameter" should be understood, when used relative to a body having a non-circular cross section, to be the "mean diameter," and the term "radius" should be construed as "mean radius."

The expansion results in a reduction of the body wall thickness and an increase in the diameter of the can. As an example, a can formed according to the present invention could be expanded from an original diameter of 2-7/16 inches to 2-11/16 inches. In addition to an increase in the volume containable within the can body, the radial expansion thereof also results in a work hardening of the wall, thereby producing a stronger can body. Adjacent each end, the can body is held at its original dimension so as to form necks which serve to increase the can strength and reduce spillage during filling. Each end of the body, beyond the necks, is bent in a radially outward direction to create a flange for attachment of a can end thereto in a well-known manner. The can ends, which are rolled onto the flanges, are, in the above example, the same ends which would be required for a 2-7/16 inch can rather than those required for a 2-11/16 inch can, thereby further decreasing the amount of metal required to form a can according to the present invention. This last feature also means that when the can ends are put onto the body, they will not have a diameter as large as the expanded portion of the body, thereby allowing adjacent cans to be more closely stacked together since the exterior surfaces of cans will be in contact throughout the expanded portions thereof and the cans will not be held apart by abutment of the ends. In other words, the external wall surfaces of the bodies will be in abutment, thereby resulting in a decreased storage space requirement for a given number of cans.

Those skilled in the art will realize, of course, that when one of the previously described aluminum drawn cans is so formed, only the upper, open end of the can needs to be flanged for receipt of a can end and, unless desired, the closed end of the can need not be necked.

In forming the can bodies in accordance with the present invention, a cylindrical body is placed within a multi-part die having internal structure for producing the entire desired body shape, including the necks and flanges. A mandrel is placed within the can body and a force is exerted thereon which causes the mandrel to expand against the internal die structure so as to be formed thereagainst. In the areas in which necks are to be formed, the body is held at its original diameter by the die structure and the wall between the necks is expanded to the desired shape. The ends of the body beyond the necks are formed about the die necking structure into can end-receiving flanges.

When elastomeric mandrels are used to expand and reshape the can bodies, the mandrels must be manufactured so that they extend beyond one end of the die structure to provide sufficient material for radial expansion thereof. The provision of a compressible circumferential groove in the mandrel allows the mandrel to flow in such a way that it cannot reach behind the end of the can body which is to be flanged adjacent the end of the die from which the mandrel extends. If the mandrel could flow behind that end of the can body and come between the body and the die, it would prevent proper formation of the flange and the mandrel would quickly become damaged by the sharp end of the body.

Expansion of cans in accordance with this invention allows them to be automatically tested for seam strength, eliminating the time and labor previously required to accomplish this result.

When it is desirable to use an elastomeric mandrel, but undesirable to lubricate the circumferential surface thereof—as is sometimes necessary for insertion and removal of the mandrel relative to the can body—the mandrel may be provided with a longitudinally tapered or conical surface which is truncated in the area of the circumferential groove. This type of mandrel provides the added feature of allowing the can body to be formed with an "ironing effect" so that the expansion of the body occurs progressively from one end of the body toward the other, thereby obviating any possibility of wrinkles forming in the body wall. Additionally, this progressive expansion of the can body may, when certain materials are used, allow the body to be stretched in the axial direction, thereby allowing cans of a predetermined length to be formed from bodies which have been manufactured with a slightly shorter axial dimension. This, of course, results in a further economic benefit due to the reduction of metal required to form a can.

In summary, the present invention produces a can body which requires less metal and weight in both the body and the ends than heretofore possible, while allowing a larger number of cans of an effective diameter to be stored in any given area. Further, the invention allows the cans to be formed in a single step, thereby obviating the previous requirement for a plurality of machines to accomplish necking and flanging. The method of this invention may be used to form a very wide variety of can shapes and may be used with many presently known materials such as tin-free steel, tin-plated steel, aluminum, etc.

Other objects, advantages, modes, and embodiments of the present invention will become obvious to those skilled in the art through reference to the Detailed Description and accompanying drawings which illustrate what are presently considered to be preferred embodiments of the best mode contemplated for utilizing the novel principles set forth in the claims.

DETAILED DESCRIPTION

Figures 1, 2:
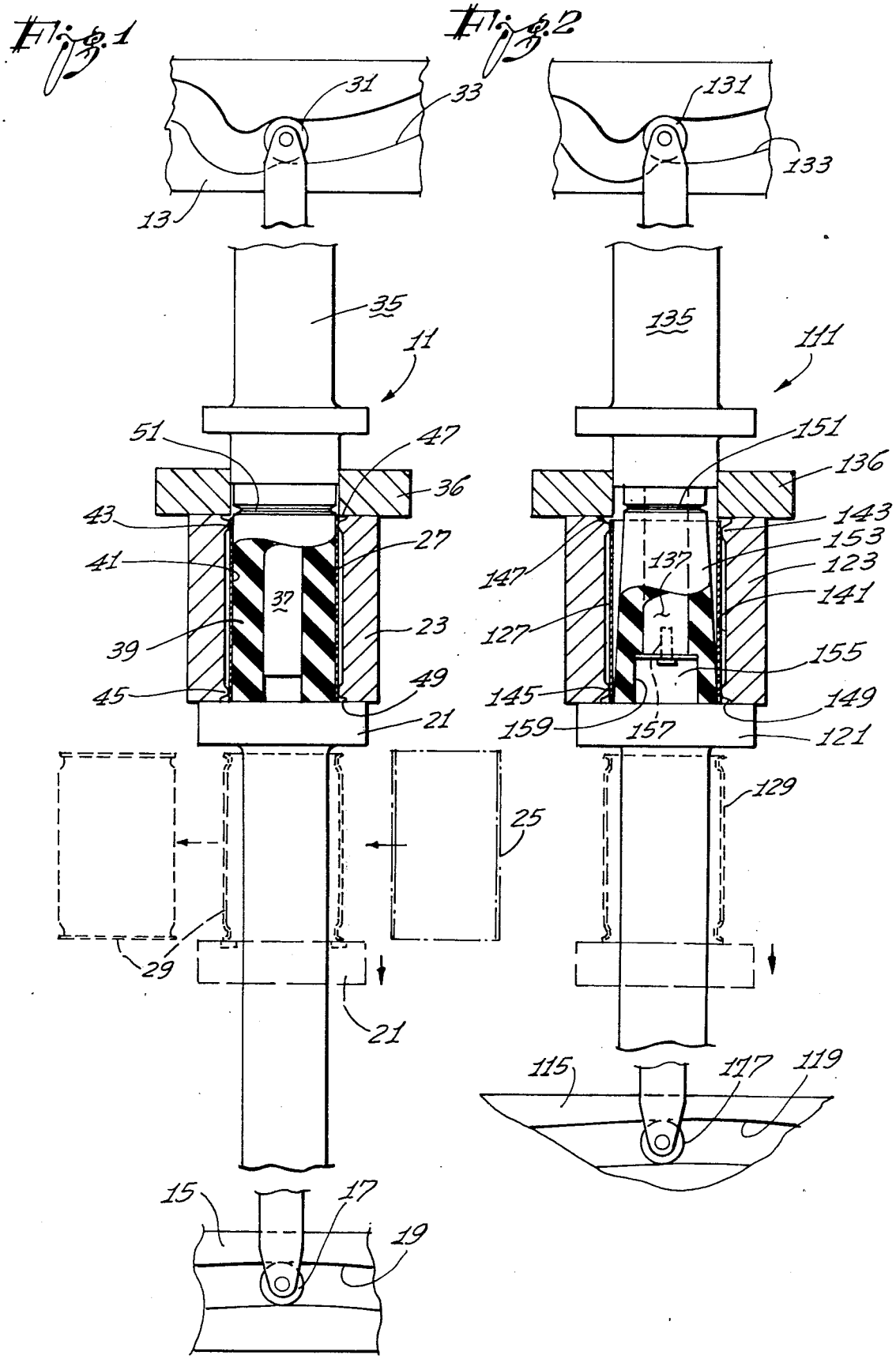
FIGS. 1 and 2 are elevations, partly in section, of two embodiments of structure which may be utilized to form the product of this invention according to the method hereof.

As shown in FIG. 1, a can body forming machine element 11, forms one station of a multi-station machine in which a large plurality of can bodies are formed sequentially and/or simultaneously. The machine rotates about a vertical axis (not shown) which is coaxial with a fixed upper drum cam 13 and a fixed lower drum cam 15. As the element 11 is carried in rotation about the axis of the machine, a cam follower 17 cooperates with a cam groove 19 in the lower drum cam 15 to reciprocate a support member 21 relative to a multi-part die 23. As the machine is carried about the axis, the support is moved into position to receive a can body or workpiece 25 from any suitable feed means, such as a starwheel (not shown), when the support member 21 is in the lowered position shown in phantom in FIG. 1. As the support member is moved upwardly due to the cooperation of the follower 17 and cam groove 19, it moves the workpiece into the opened die 23. The die is then closed about the body which is held in the position illustrated at 27. When can body or workpiece 27 has been formed, in a manner to be described, the die will be reopened and continued movement of the element 11 about the machine axis will cause support member 21 to be moved downwardly and the formed can body 29 will be removed from the support member 21 by any suitable machinery.

An upper cam follower 31 cooperates with a cam groove 33 in the upper drum cam 13 so as to reciprocate a punch 35 through a support plate 36 and relative to the die 23. Cam groove 33 is so formed that punch 35 is reciprocated to the position illustrated in FIG. 1 and is then moved downwardly still further during the period in which the can body is to be formed.

Those skilled in the art will realize that it may be unnecessary to reciprocate the mandrel so that it is withdrawn from the die so long as the can may be easily moved over it as the can is placed within the die. Any combination of mandrel, die, and support movement can be provided so long as the total effect is to position the can in the die and the mandrel in the can, and to allow the mandrel to be worked to form the can.

A pilot rod 37 is suitably fastened to the punch 35 and an elastomeric mandrel 39, which may be of any suitable material, such as rubber, is fitted over the pilot rod for close abutment with the punch as shown. The mandrel may be either bonded to the punch or held thereagainst by "shrink-fitting" it onto the pilot rod.

The multi-part die 23 is formed, in the illustration of FIG. 1, with a circumferentially recessed portion 41, hereafter referred to as the "expansion section," between radially inwardly directed portions 43 and 45, hereafter referred to as "neckers". A pair of circumferentially recessed portions 47 and 49, hereafter referred to as "flangers," are formed at each end of the die structure adjacent neckers 43 and 45, respectively.

In operation, when support member 21 has moved a workpiece can body 25 into the position illustrated at 27, the die having been closed thereon, punch 35 lowers the mandrel into the workpiece can body until the mandrel 39 contacts the upper surface of support member 21. If necessary, a machine station (not shown) may be provided to lubricate the mandrel prior to its insertion into the body. Continued rotation of the machine relative to the drum cams causes punch 35 to be moved downwardly, compressing the mandrel 39 so that it expands against the body 27, forcing it into the expansion section 41 of the die between neckers 43 and 45. As this occurs, the mandrel acts against the body in the areas of the neckers 43 and 45 to hold it tightly against them, thereby stretching the body throughout the area of expansion section 41 with a resultant reduction of the can body wall thickness and increase of the body diameter in that section. Since the portions of the body adjacent neckers 43 and 45 are fixed against movement by the mandrel 39, their thicknesses and diameters will remain unchanged.

As this is occurring, mandrel 39 will also tend to expand into the flanger 49, causing the lower end of the body to be formed around the necker 45 to create a lower flange thereon. The mandrel will also expand into the flanger 47, thereby forming a similar flange at the upper end of the body. A circumferential groove 51 in the mandrel 39, which will be more fully described later, allows the mandrel to be compressed at the intersection of punch support 36 and die member 23 without allowing the mandrel to flow into the area behind the can body in the flanger 47. If it did flow behind the can, it would interfere with the formation of the upper flange and would eventually become damaged by the sharp upper edge of the blank. This problem is obviated at the lower flanger 49 since the mandrel does not extend below the lower extremity of die 23 and it cannot flow into the flanger until the flange is formed.

Referring now to FIG. 2, it will be seen that the structure therein is similar in many respects to that previously described relative to FIG. 1. Elements which are nearly identical have been provided with identical identification labels, preceded by the numeral "1," so that machine element 11 of FIG. 1 becomes machine element 111 in FIG. 2, etc. Therefore, only those structural elements which are different from those described relative to FIG. 1 need to be described with reference to FIG. 2.

A mandrel 153 within the machine element 111 is formed with a tapered external surface of conical configuration which is truncated in the area of the groove 151. The mandrel may be fastened to the punch 135 by any of the alternatives previously described relative to mandrel 39, but to illustrate a further alternative it has been shown to be fixed to punch 135 by means of a plate 155 which is fastened to the pilot rod 137 by any suitable fastening means, such as a bolt 157. The plate fits within a circular "counterbore" 159 in the mandrel 153 and, when the punch 135 is in the upper position, seats against the bottom of the "counterbore."

Figure 3:
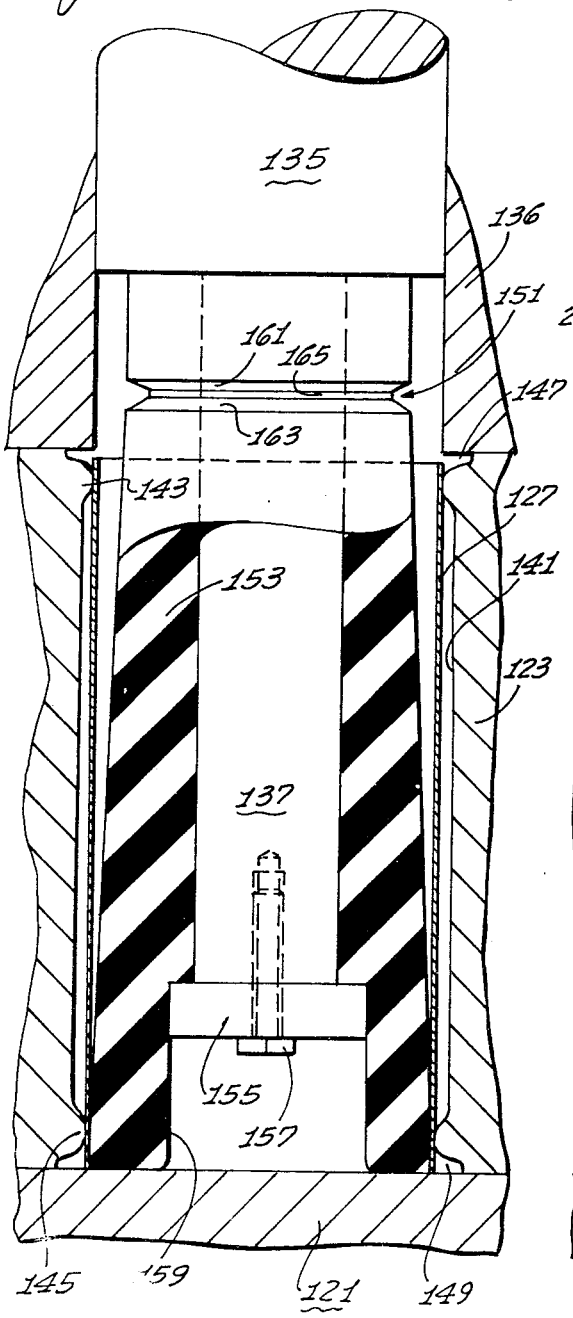
FIG. 3 is an enlarged illustration of the product forming apparatus according to the embodiment of FIG. 2.

As shown more clearly in FIG. 3, the can body 127 is not long enough to extend up to the upper end of the die when support 121 abuts the die. When mandrel 153 is placed into the body 127, the bottom end thereof will abut the support 121. As punch 135 is actuated, the mandrel will hold the bottom portion of the body against necker 145 to prevent movement of the body, in the manner previously described. Further actuation of the punch 135 causes the lower end of the mandrel to bend the bottom end of the body into the flanger 149; at the same time, the forces acting on the mandrel move it against the body 127 in the area of the expansion section 141. Since the mandrel is conical in configuration, its contact with the body and the resultant reshaping occurs progressively upwardly so that the body wall becomes thinner and may, with suitable body material selection, become lengthened toward the upper end of the die. Thus, it will be seen, that the particular configuration of the mandrel described may cause the body wall to be reduced in thickness while being increased in length. Further, the configuration results in an "ironing effect" on the body so that no wrinkles can be formed in the expansion section. Now turning to FIG. 5, it can be seen that, as the mandrel 153 moves the can body 127 into the expansion section 141, the can body will be lengthened until the top edge thereof is coplanar with the upper end of the die.

Figure 5:
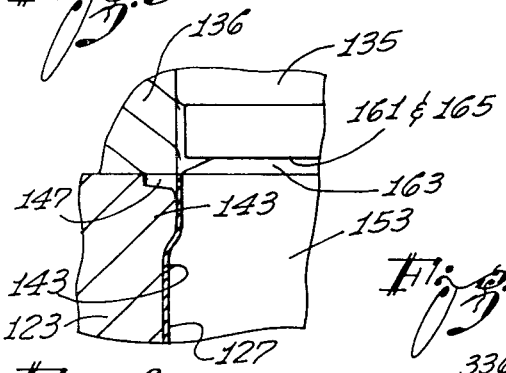
FIGS. 5 and 6 are illustrations of consecutive positions assumed by part of the apparatus of FIGS. 2 and 3 during operation thereof.
Figure 6:
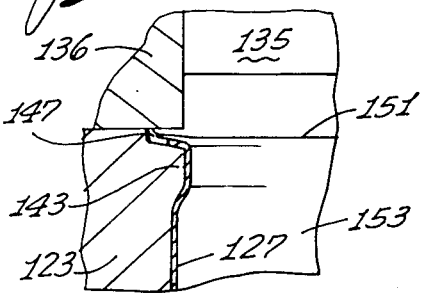

FIGS. 5 and 6 will be described with reference to the embodiment of FIG. 2, but it should be borne in mind that the actual flanging action is identical for the structure of either FIG. 1 or 2. Referring now to FIGS. 3, 5, and 6 together, the circumferential groove 151 comprises an upper tapered section 161 and a lower tapered section 163 which are joined by a vertical section 165. When the mandrel has been compressed to the position shown in FIG. 5, the upper tapered section 161 and the vertical section 165 will have become compressed to form an horizontal section and the lower tapered section 163 will have become compressed so that the lower edge thereof will expand outwardly to the upper end of the can body. Still further downward movement of the punch 135 to the position shown in FIG. 6 will result in a complete closure of the groove 151 and an extension of the opposite sides thereof into the flanger 147 to form a flange on the can body 127 about the upper edge of the necker 143.

As previously stated, circumferential grooves 51 and 151 are identical, as is their cooperation with the flangers 47 and 147, respectively.

Figure 4:
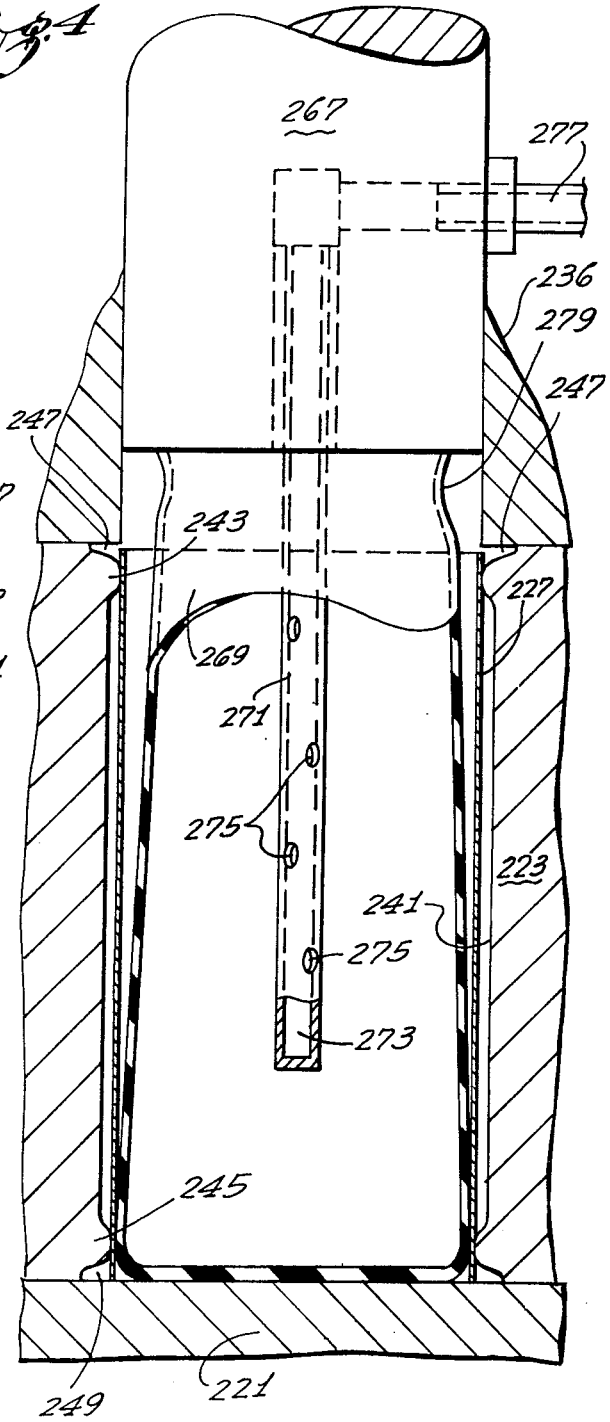
FIG. 4 is a view, similar to FIG. 3, of a third embodiment of apparatus which may be utilized in accordance with the present invention.

Now with reference to FIG. 4, a third embodiment of an apparatus which may be utilized in accordance with the present invention has been illustrated. Those portions of the structure which are identical to previously described portions have been given identical labels, preceded by the numeral "2", such that support 21 or 121 now becomes 221; further description of such identical elements is believed to be unnecessary.

As shown in that embodiment, a "punch" member 267 is suitably fastened by any desired means to a sealed, flexible, diaphragm-like member 269 which, if desired, may be tapered in the same manner in which mandrel 153 was tapered, or may be formed in any other suitable shape. A pipe 271, having a central bore 273 which is in communication with the internal volume of the flexible member 269 by means of a plurality of apertures 275, extends into the support member 267 for communication with a fluid passage 277. Fluid, such as air, water, etc., may be pumped into the flexible member 269, through the passage 277 and pipe 271, so that the flexible member will form the can body 227 in the manner described relative to the embodiment of either FIG. 1 or FIG. 2. When the can has been formed, the fluid circuit may be reversed and the fluid withdrawn from the flexible member 269 through the pipe and passage, allowing contraction of the flexible member for removal from the formed can body.

The member 267 may, if desired, also be reciprocable within the support plate 236 so as to increase the pressure within the flexible member. Further, the flexible member may be provided with a constricted portion 279 which will cooperate with the flanger 247 in a manner which is similar to that described relative to groove 151.

Figure 7:
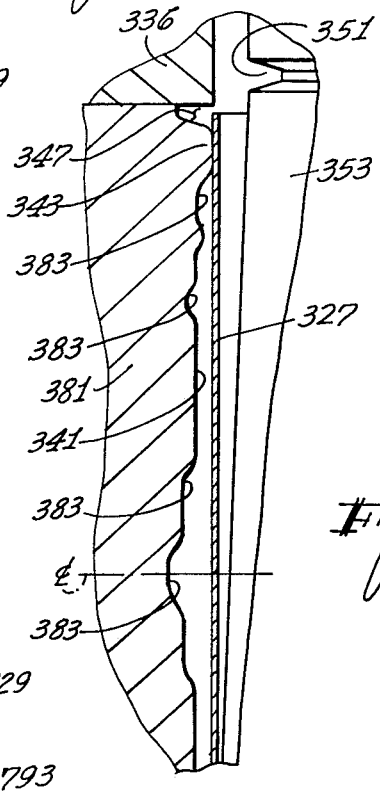
FIG. 7 is a partial sectional view of an apparatus which is similar to that illustrated in FIGS. 2 and 3, having a modified die structure therein.

Referring now to FIG. 7, an embodiment of the invention has been partially illustrated in which parts which are identical to those previously described have been labeled with an identical label, preceded by the numeral "3."

As shown, a die 381 has been positioned for cooperation with a mandrel 353 to form a can body 327 in the manner previously described. In this embodiment, however, the expansion area 341 has been provided with a plurality of recessed portions 383 of varying shapes and diameters, so that, as the can is formed, it can be embossed in predetermined areas through cooperation with the die 381.

Figure 8:
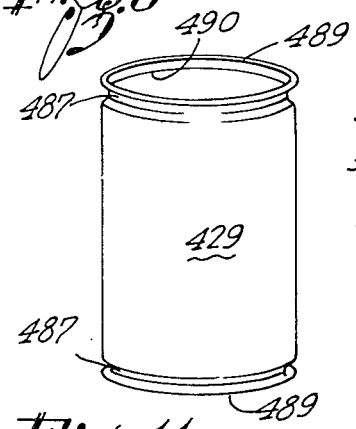
FIGS. 8–12 illustrate various configurations into which cans formed by the present invention may be shaped.
Figure 9:
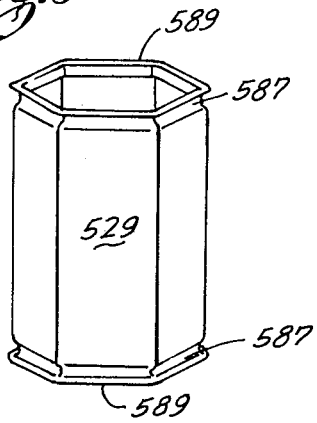

As shown in FIGS. 8–12, a variety of can sizes, shapes, and embossing configurations can be provided in accordance with the present invention. In FIG. 8, a can body 429 has been shown which is circular in cross section, having wall strengthening necked portions 487 which are equal to the original wall thickness and diameter of the can, and end flanges 489. The internal surface edge 490 of the necks serve an added function in that they reduce liquid splash and loss when the can is filled with the product at a later time. In FIG. 9, an hexagonal can 529 is shown having necked portions 587 and flanges 589. Similarly, in FIG. 10, a square can body 629 has been illustrated having necks 687 and flanges 689. Obviously, in the case of such shapes, some reforming in the neck and flange area will occur, but this will be negligible in comparison with the reforming of the intermediate section.

Figure 11:
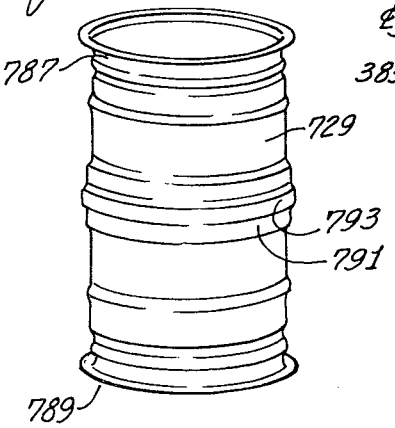
Figure 10:
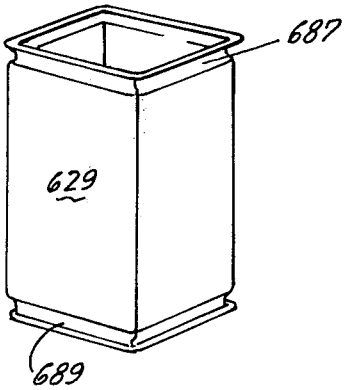

FIG. 11 shows a generally circular can body 729 having necks 787 and flanges 789. As shown, the can may be provided with embossed portions such as 791 and 793 which, for example, would correspond to the configurations shown in the recess portions 383 of FIG. 7.

Figure 12:
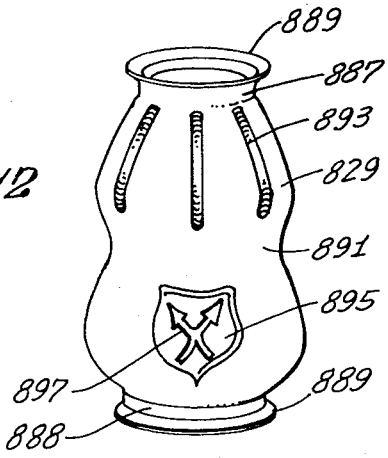

Now with reference to FIG. 12, a can body 829 has been illustrated having necks 887 and 888 and flanges 889. As shown, a variety of different features may be provided in a single can body, such as a central constriction 891, longitudinal embossments 893, artistic designs such as an embossed shield 895 having crossed spears 897 embossed upon the embossment, etc. In other words, the use of the apparatus and/or method of the present invention will provide relatively limitless configurations, dependent only upon the inherent limitations of the process and the design capabilities of its user.

It will be noted relative to FIG. 12 that the diameter of neck 888 has been expanded somewhat, whereas the diameter of neck 887 has been maintained at its original dimension. When cans are formed in the shapes shown in FIGS. 8–12 with similar differences in neck and end diameters, improved stacking of cans will result since the smaller can ends, on the body ends having smaller neck diameters, will fit within the larger can ends on the larger necks. Thus, utilization of storage space can also be improved in this manner.

Figure 13:
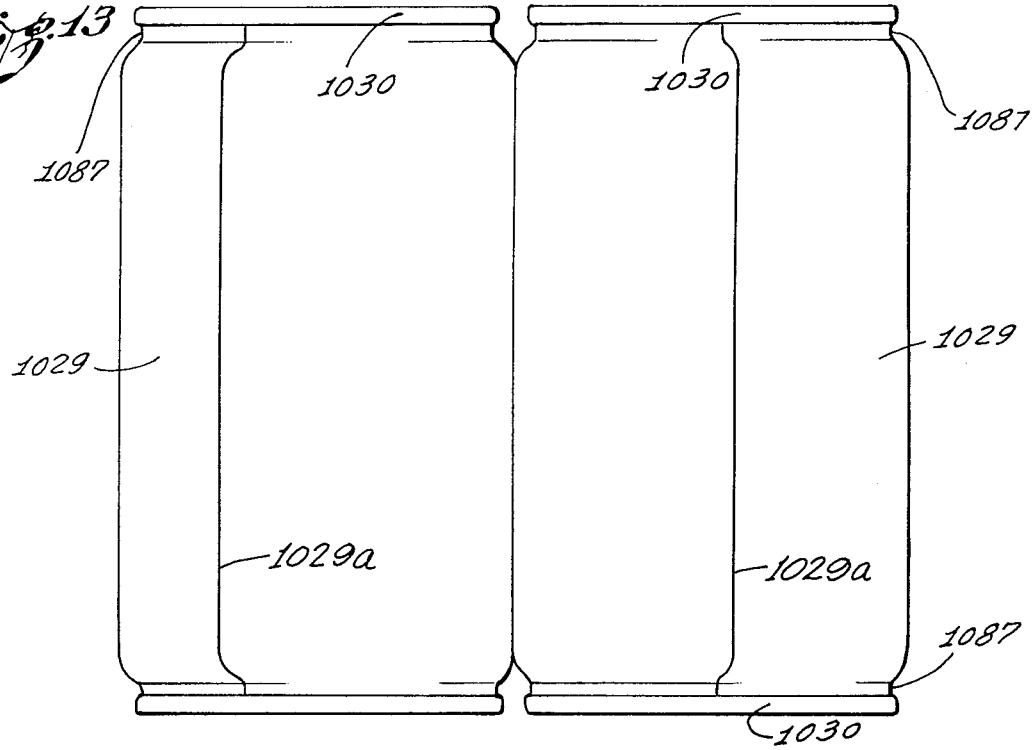
FIG. 13 is an elevation of two cans formed according to the present invention and placed in abutment.
Figure 14:
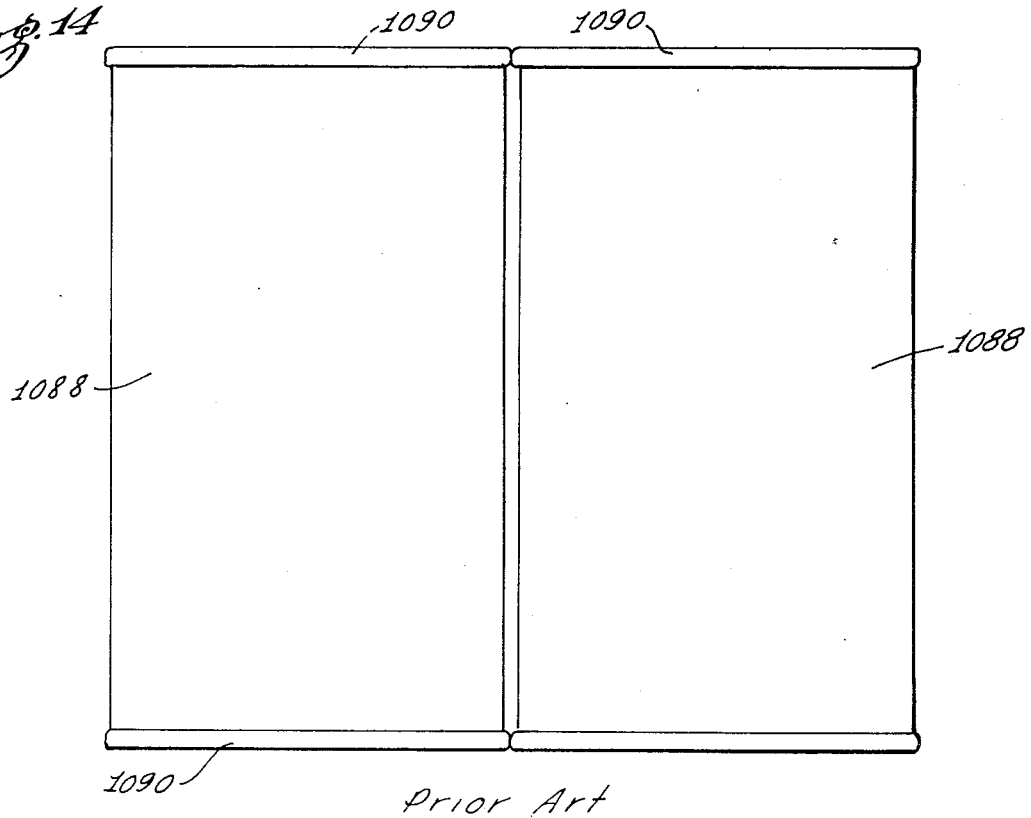
FIG. 14 is a view, similar to FIG. 13, of cans formed according to prior art methods.

Referring now to FIGS. 13 and 14, there is clearly illustrated the storage advantage of the cans formed according to the present invention over the prior art. As shown in FIG. 13, a pair of cylindrical cans 1029 having seams 1029a are in abutment throughout the expanded mid-sections of their lengths and their can ends 1030 are held apart due to the configuration of the can necks 1087. The prior art cans 1088 shown in FIG. 14, however, are not in contact along the body walls but are separated by the abutment of the overhanging ends 1090. Thus it can be seen that cans of a predetermined size, e.g., 2-11/16 inches, which are formed according to the present invention, may be placed closer together than prior art cans of an identical size, thereby saving storage and shipping space.

No matter how a can is configured or what material it is made from, the invention herein provides a new and improved concept in the can-making art which yields a true advance in that art. The invention allows the production of can bodies in a highly economical way since the amount of material used in a can is reduced by means of a reduction in wall thickness, an increase in the length of the wall, if desired, and the use of smaller ends. Also, the body is formed in a single operation, eliminating the need for a plurality of machines to perform necking and flanging in separate steps. Of course, the invention should not be construed so as to preclude the formation of the flange in a separate operation, if that should be desirable in certain instances.

While a few preferred embodiments of the invention have been illustrated, it will, of course, be realized that they are capable of variation and modification in a variety of ways without exceeding the scope of the invention.

We claim:

1. Apparatus for forming a cylindrical can body from a workpiece of substantially circular cross section comprising
a male mandrel
a female die having
a face shaped in accordance with the desired can shape including
flange forming means adjacent at least one axial end thereof for receiving the end of the workpiece upon formation thereof,
neck forming means, adjacent said flange forming means, of a diameter substantially equal to that of the workpiece to provide a neck on the can being formed which has a diameter which is substantially equal to that of the workpiece, and
an expanded section forming means on the side of said neck forming means opposite said flange forming means and extending toward the distal end of said female die,
means for locating said mandrel within said die adjacent said face,
means for positioning a workpiece within said die between said mandrel and said die face, and
means for exerting a force on said mandrel to cause it to exert a generally radially outwardly directed force over the entire length of the can body to form a flange, neck, and expanded section in the workpiece.

2. The apparatus of claim 1 wherein
said female die face further includes
said flange forming means and said neck forming means adjacent both ends thereof.

3. The apparatus of claim 2 wherein
said mandrel comprises a substantially cylindrical elastomeric member whereby, when said force exerting means acts upon said mandrel, the workpiece is initially fixed against said neck forming means and subsequently expanded, between the portions thereof thus fixed, into said receiving means.

4. The apparatus of claim 2 wherein
said mandrel comprises a substantially conically tapered elastometric member whereby, when said force exerting means acts upon said mandrel, the workpiece is initially fixed against one of said neck forming means, progressively expanded into said expanded section forming means in an axial direction toward the other of said neck forming means, and finally fixed against the other of said neck forming means.

5. The apparatus of claim 1 wherein
said mandrel comprises an expandable member and
said means for exerting a force on said mandrel comprises
means for injecting a fluid into said expandable member.

6. The apparatus of claim 1 including means on said mandrel for preventing said mandrel from entering said flange forming means, when a workpiece is positioned in said die, until a flange has been substantially fully formed on the workpiece.

7. Apparatus for providing a desired shape in a can body comprising
a die member having
an inner face upon which is formed
a neck forming member closely adjacent at least one axial end of said die and of a diameter substantially the same as the outer diameter of a workpiece can body to be thus shaped,
an expansion section adjacent said neck forming member and extending away from said at least one axial end of said die and toward the other axial end thereof, and
a flange forming section immediately adjacent at least one axial end of said die, and
means for exerting a substantially radially directed force against the interior of a can body positioned within said die to cause the can body to be formed against said die face.

8. Apparatus for providing a desired shape in a can body comprising
a die member having
an inner face including
structure against which a can body may be forced for shaping thereof, and
an elastomeric mandrel within said die member and substantially coaxial therewith,
means for causing said mandrel to flow against a can body positioned within said die to force the can body against said die face structure, and
means on said mandrel for preventing said mandrel from flowing behind an end of a can body positioned within said die, thereby preventing obstruction of the shaping of the end of the can body and damage to the mandrel.

9. The apparatus of claim 8 wherein
said preventing means on said mandrel comprises
a peripheral groove therein having
a first tapered section extending inwardly from the periphery of said mandrel,
a second tapered section extending inwardly from the periphery of said mandrel, and
a generally axially directed section extending between said first and second tapered sections.

10. The apparatus of claim 9 wherein
said generally axially directed section is of a diameter, relative to the mandrel axis, which is less than that of the periphery of the mandrel adjacent said groove.

11. The apparatus of claim 8 wherein
said elastomeric mandrel comprises
an elongated member having
a peripheral surface of a tapered, conical configuration.

* * * * *